US012601108B2

(12) United States Patent
Veran

(10) Patent No.: US 12,601,108 B2
(45) Date of Patent: Apr. 14, 2026

(54) COATED LIGHTWEIGHT FABRIC, IN PARTICULAR FOR A SPINNAKER

(71) Applicant: PORCHER INDUSTRIES, Eclose-Badinieres (FR)

(72) Inventor: Stéphane Veran, Aix les Bains (FR)

(73) Assignee: PORCHER INDUSTRIES, Eclose-Badinieres (FR)

( * ) Notice: Subject to any disclaimer, the term of this patent is extended or adjusted under 35 U.S.C. 154(b) by 496 days.

(21) Appl. No.: 18/027,454

(22) PCT Filed: Oct. 4, 2021

(86) PCT No.: PCT/EP2021/077234
§ 371 (c)(1),
(2) Date: Mar. 21, 2023

(87) PCT Pub. No.: WO2022/073901
PCT Pub. Date: Apr. 14, 2022

(65) Prior Publication Data

US 2023/0366147 A1 Nov. 16, 2023

(30) Foreign Application Priority Data

Oct. 5, 2020 (FR) ..... 2010144

(51) Int. Cl.

| | |
|---|---|
| ***D06N 3/14*** | (2006.01) |
| ***B63H 9/067*** | (2020.01) |
| ***D03D 1/00*** | (2006.01) |
| ***D03D 13/00*** | (2006.01) |
| ***D03D 15/283*** | (2021.01) |
| ***D03D 15/573*** | (2021.01) |
| ***D06N 3/00*** | (2006.01) |
| ***D06P 3/52*** | (2006.01) |
| ***D06P 5/28*** | (2006.01) |

(52) U.S. Cl.
CPC ..... *D06N 3/14* (2013.01); *B63H 9/067* (2020.02); *D03D 1/00* (2013.01); *D03D 13/008* (2013.01); *D03D 15/283* (2021.01); *D03D 15/573* (2021.01); *D06N 3/0006* (2013.01); *D06N 3/0036* (2013.01); *D06N 3/148* (2013.01); *D06P 3/52* (2013.01); *D06P 5/005* (2013.01); *D06N 2201/02* (2013.01); *D06N 2205/16* (2013.01); *D06N 2205/20* (2013.01); *D06N 2209/103* (2013.01); *D06N 2211/00* (2013.01); *D10B 2331/04* (2013.01); *D10B 2401/06* (2013.01); *D10B 2507/04* (2013.01)

(58) Field of Classification Search
None
See application file for complete search history.

(56) References Cited

U.S. PATENT DOCUMENTS

| | | | |
|---|---|---|---|
| 3,680,519 | A | 8/1972 | Jalbert |
| 4,679,519 | A | 7/1987 | Linville |
| 4,708,080 | A | 11/1987 | Conrad |
| 4,973,510 | A | 11/1990 | Tanaka |
| 5,097,783 | A | 3/1992 | Linville |
| 5,097,784 | A | 3/1992 | Baudet |
| 5,273,813 | A | 12/1993 | Akamatsu et al. |
| 6,311,633 | B1 | 11/2001 | Keire |
| 2004/0188567 | A1 | 9/2004 | Logosz |
| 2007/0218793 | A1 | 9/2007 | Rossignol |
| 2010/0139540 | A1 | 6/2010 | Cronburg et al. |
| 2011/0130061 | A1 | 6/2011 | Tanaka et al. |
| 2012/0085456 | A1 | 4/2012 | Guimbard |
| 2013/0075533 | A1 | 3/2013 | Veran |
| 2019/0368124 | A1 | 12/2019 | Furui et al. |
| 2021/0262286 | A1 | 8/2021 | Campagna et al. |
| 2024/0084504 | A1* | 3/2024 | Veran ..... D06N 3/0036 |

FOREIGN PATENT DOCUMENTS

| | | |
|---|---|---|
| CA | 2123263 | 11/1994 |
| CN | 101790609 | 7/2010 |
| DE | 8707788 | 8/1987 |
| DE | 10006100 | 8/2001 |
| DE | 102005052333 | 5/2007 |
| DE | 202009004621 | 9/2009 |
| EP | 224729 | 6/1987 |
| EP | 305888 | 3/1989 |
| EP | 111477 | 7/2001 |
| EP | 2475577 | 7/2012 |
| FR | 2775656 | 9/1999 |

(Continued)

OTHER PUBLICATIONS

International Search Report for PCT/EP2021/077234 dated Jan. 19, 2022.
Preliminary Search Report for FR 2010144 dated Mar. 9, 2021.

*Primary Examiner* — Arti Singh-Pandey
(74) *Attorney, Agent, or Firm* — B. Aaron Schulman, Esq.; Stites & Harbison, PLLC

(57) ABSTRACT

The disclosure relates to a fabric for lightweight nautical sails, such as spinnakers, asymmetric spinnakers, and gennakers, for sailboats and other surface vessels, the fabric being formed of continuous polyester warp and weft yarns and being coated on one or both of its two surfaces with a crosslinked polymer, wherein the polyester is poly(ethylene terephthalate) (PET) having a tenacity greater than or equal to 6 cN/dtex; in that the fabric has a density of between 20 and 50 threads/cm. The coated fabric has an elongation in the bias direction under 20 Lbs, comprised between 10 and 30 hundredths of an inch.

24 Claims, No Drawings

(56) References Cited

FOREIGN PATENT DOCUMENTS

| | | | |
|---|---|---|---|
| FR | 2840625 | | 12/2003 |
| JP | 2000234272 | | 8/2000 |
| JP | 2005097787 | A | 4/2005 |
| JP | 2005133253 | | 5/2005 |
| JP | 2008002056 | | 1/2008 |
| JP | 4369190 | | 11/2009 |
| TW | 200936839 | A | 9/2009 |
| TW | 201833406 | A | 9/2018 |
| TW | 201925385 | A | 7/2019 |
| WO | WO 2011/029851 | | 3/2011 |
| WO | WO 2011/042653 | | 4/2011 |

* cited by examiner

COATED LIGHTWEIGHT FABRIC, IN PARTICULAR FOR A SPINNAKER

The present invention relates to a lightweight fabric formed of continuous warp yarns and weft yarns, this fabric being coated on one and/or both of its two surfaces with a polyurethane. The field of application for this lightweight fabric in particular includes lightweight headsails, such as spinnakers, asymmetric spinnakers, and gennakers, for sailboats and other surface vessels. The invention also relates to a fabric production method for producing this fabric.

A spinnaker, upon being inflated by the wind, must have a very precise aerodynamic form. The use of a stiff fabric is thus preferred in order to facilitate inflation and maintenance of the ideal shape and form. The stiffness of the fabric has the downside in that fabrics so obtained are conducive to tearing under high stress, causing the spinnaker to break up or burst. Traditionally, the use of fabrics made of Polyamide 6.6 based textile is preferred, given the shock absorbing ability thereof attributable to the high elasticity and tenacity of polyamide 6.6. However this polyamide has certain drawbacks. Polyamide 6.6 is a hydrophilic polymer which provides the fibre with a propensity to absorb water. A spinnaker made from a polyamide 6.6 based fabric thus then has a tendency to become heavier and to age prematurely under the combined action of UV rays and hydrolysis. For their part, polyester based fabrics, that are less sensitive to water uptake, have proved in practice to be too stiff to be able to be used on sails such as spinnakers. The use of high tenacity polyester fibres, preferably polyethylene terephthalate fibres, supposed to provide even greater tear resistance, has not in practice resulted in use thereof in spinnakers, the considerable stiffness of the sails thus produced rendering them prone to breaking up and bursting under high stresses.

Another deficiency in fabrics for spinnakers is that they are not suitable for receiving a durable decoration, in particular by modern printing techniques, after the sail has been fabricated.

The objective of the present invention is to remedy the drawbacks of the prior art, by providing a fabric formed from polyester fibres that exhibits a tear resistance, and has a modulus and elasticity that enable use thereof in the production and use of lightweight headsails, such as spinnakers, asymmetric spinnakers, and gennakers, for sailboats and other surface vessels.

Another objective of the invention is to provide such a fabric having lower water absorption, and exhibiting greater hydrolysis resistance, than the existing solutions based on polyamide fabric.

Another objective of the invention is to provide a fabric that has high thermal stability which makes it possible for the fabric to be sublimation printed.

Still other objectives will become apparent upon reading the description of the invention.

These and other objectives are achieved by a fabric formed from high tenacity continuous polyester warp and weft yarns. The fabric is coated on one or both of its two surfaces with a crosslinked polyurethane (PU). The crosslinked PU according to the invention has the ability to compensate for the excessive stiffness (extremely high modulus) and the low elasticity of fabrics made of high tenacity polyester fibres. Crosslinked polyurethane is flexible and is therefore durable against the mechanical stresses that the sail is subjected to during its useful life. Preferably, the polyurethane is a polyether-, polyester-, or polycarbonate based PU. The preferred polyurethane is a polycarbonate based PU. According to another preferred characteristic feature, the PU is obtained from a single-component polyurethane elastomer. This elastomer is formed from polyol segments (polyether, polyester or polycarbonate), isocyanate segments, and a chain extender or hydroxylated crosslinking agent, as is known per se. One important preferred characteristic feature is that the elastomer has a modulus at 100% elongation less than or equal to approximately 15 MPa, in particular comprised between 1 and 15 MPa according to the standard DIN 53504. More advantageously, this modulus is comprised between 2 and 15 MPa, in particular between 6 and 15 MPa, indeed more particularly between 6 and 10 MPa, typically between 6 and 9.5 MPa, for example approximately 8 MPa, according to the standard DIN 53504. Another important preferred characteristic feature is that the elastomer is in a mixture with a crosslinking agent (not to be confused with the crosslinking agent used so as to form the elastomer), and that the proportion of dry crosslinking agent relative to the dry elastomer is between approximately 20% and approximately 75%, better still between approximately 30% and approximately 75% by weight, in particular between approximately 40% and approximately 75% by weight, in particular between approximately 50% and approximately 75% by weight (for example, approximately 67%). The crosslinking agent comprises in particular an isocyanate, melamine, or a mixture of isocyanate and melamine.

This crosslinking agent makes it possible in particular to block all or part of the reactive functional groups (in particular NCO and alcohol) remaining on the elastomer, to create additional bonds or crosslinks, and to obtain the crosslinked PU forming the coating of the fabric. The fabric according to the invention is intended for, or capable of forming, the lightweight headsails, such as spinnakers, asymmetric spinnakers, and gennakers, for sailboats and other surface vessels.

The invention relates in particular, to a fabric for lightweight nautical sails, such as spinnakers, asymmetric spinnakers, and gennakers, for sailboats and other surface vessels the fabric being formed of continuous polyester warp and weft yarns and being coated on one or both of its two surfaces with a crosslinked polymer, characterised in that the polyester is poly(ethylene terephthalate) (PET); in that the fabric has a density of between 20 and 50 threads/cm, preferably between 25 and 50 threads/cm, in terms of warp and weft density; in that the polymer is a crosslinked polyurethane (PU) that is polyether-, polyester-, or polycarbonate based, preferably polycarbonate based; and in that this PU is derived from the crosslinking (1) of a single-component polyurethane elastomer having a modulus at 100% elongation less than or equal to approximately 15 MPa, in particular comprised between 1 and 15 MPa, in particular between 2 and 15 MPa, more particularly still between 6 and 15 MPa, typically between 6 and 10 MPa, for example between 6 and 9.5 MPa, for example approximately 8 MPa according to the standard DIN 53504, used in implementation in organic solvent phase (in particular dissolved in a solvent); (2) by a crosslinking agent, based on a proportion of dry crosslinking agent relative to the dry elastomer of between approximately 20% and approximately 75% by weight, better still between approximately 30% and approximately 75% by weight, in particular between approximately 40% and approximately 75% by weight, in particular between approximately 50% and approximately 75% by weight.

Advantageously, the coated fabric has an elongation in the bias direction under 20 lbs, comprised between 10 and 30 hundredths of an inch, preferably between 14 and 25 hundredths of an inch, according to the standard NF EN ISO 13934-1. The combination of the 100% elongation modulus of the PU and the proportion of crosslinking agent, each taken within the given intervals, provides the ability in particular to obtain this elongation in the bias direction, making it possible to provide the flexibility to the fabric that is necessary for the application but which by no means could have been anticipated given the intrinsic tenacity of the PET yarn. The high range of modulus values may in particular be favoured when the proportion of crosslinking agent is in the lower range of values, and vice versa.

The rate of dry coating relative to the total dry fabric may be in particular greater than 5%, in particular between 5% and 30% by weight, in particular between 10% and 30% by weight, better still between 15% and 25% by weight. The rate of dry coating is the ratio by weight of dry coating (crosslinked PU) on the coated fabric; it is representative of the weight of the dried/crosslinked coating present on the final fabric. The rate of dry coating mentioned herein is understood to refer to the total rate of coating, either on one surface or on two surfaces, as the case may be.

Preferably, the polyester is poly(ethylene terephthalate) or PET. PET is made up of repeating units of ethylene terephthalate; however, the scope of the invention indeed also extends to variants comprising a minor amount of other units, for example less than 10 mol %, in particular less than 5 mol % of other units, per molecular chain of the polyester (in order to form these other units the comonomers include, for example, isophthalic acid, naphthalene dicarboxylic acids, adipic acid, hydroxybenzoic acids, diethylene glycol, propylene glycol, trimellitic acid, and pentaerythritol).

The polyester yarns are multifilament yarns. They are formed from multiple continuous filaments. According to one embodiment, the fabric comprises warp yarns and weft yarns which have a dtex of between 11 and 235 dtex, for example between 22 and 110 dtex, in particular between 22 and 78 dtex, in particular with a DPF (decitex per filament) of between 1 and 4, preferably between 1.3 and 3.5.

The tenacity of the PET yarns is in particular greater than or equal to 6 cN/dtex, in particular between 6 and 7 cN/dtex. The elongation at break thereof is in particular greater than or equal to 20%, in particular between 20 and 30%. The tenacity and elongation at break are measured according to the standard DIN EN ISO 2062.

PET fibres or yarns having these characteristic features are commercially available and/or can be produced to order.

The polyester fibres optionally contain one or more additives, for example a stabilising agent and/or an antistatic agent.

One important preferred characteristic feature is that the bare fabric has a weft density of between 20 and 50 threads/cm, preferably between 25 and 50 threads/cm, and a warp density of between 20 and 50 threads/cm, preferably between 25 and 50 threads/cm. Preferably, the yarn warp density is identical to the weft density. By way of a variant, the warp density may be different from the weft density, in particular with a 10 to 30% variation between warp and weft, with either the warp or weft density having a higher value, preferably the warp density.

In one embodiment, the fabric has a hybrid construction, making use of fibres or yarns with different counts between the warp and the weft. The fabric may thus then include warp yarns and weft yarns which have a dtex (count) of between 11 and 235 dtex, in particular between 22 and 110 dtex, in particular between 22 and 78 dtex, with the warp yarns having a higher count than the weft yarns. By way of a variant that is not preferred, it is the weft yarns that have a higher count. The term 'higher' in particular may be understood to indicate that the yarn count in one direction is 1.5 or 2 to 5 times higher than the yarn count in the other direction.

The weight of the coated fabric may in particular be between 25 and 130 g/m$^2$, preferably between 30 and 120 g/m$^2$.

The fabric of the present invention is characterised by stiffness in the bias direction. The bias is said to be the warp direction because it is measured along the direction at 45° to the warp yarns. This stiffness in the bias direction is expressed by the elongation in hundredths of inches, which is measured under a force of 20 pounds (Lbs, which is 89N) applied along the bias. This elongation characterises the stiffness of the fabric in the bias direction. The standard used is NF EN ISO 13934-1: test specimens measuring 76.2 mm in width and 300 mm in length are produced. The clamp jaws of the dynamometer are moved away from each other by 152.4 mm and the measurement is performed at a speed of 50 mm/min. In the bias direction, the test specimens are cut from the fabric according to these dimensions, by applying an angle of 45° relative to the warp direction of the fabric, then the two pieces of fabric are superimposed and subjected together to the effect of the dynamometer. The elongation in hundredths of inches in the warp and weft directions is carried out according to the same standard, and in this case a single piece of fabric is used.

The elongation in the bias direction of the coated fabric, under 20 lbs, in particular may be between 10 and 30 hundredths of an inch, preferably between 14 and 25 hundredths of an inch. This is the preferred target as established by the invention. The flexible polyurethane coating makes it possible to achieve this goal, despite the fact that the PET yarns having high Young's modulus, generally between 3 and 15 GPa, confer on the fabric high stiffness and low elasticity. A coated fabric with a bias elongation of less than 10 hundredths of an inch will be too stiff and would risk bursting under high stress. A fabric with a bias elongation greater than 30 hundredths of an inch will be too flexible or soft and will result in a sail, such as a spinnaker, having degraded aerodynamic performance.

The Young's modulus or modulus of elasticity characterising polyester or PET fibres or yarns is the pascal constant which links the stress and the deformation generated by this stress when one is within the elastic range of the material. It is obtained by measuring the slope at the origin of the force=f(deformation) curve. The elongation at break is (L−L0)/L0*100, L being the length at break and L0 the initial length of the sample.

The modulus at 100% elongation as used to characterise the elastomer is no longer the Young's modulus but an equivalent measured at 100% elongation.

The fabric of the present invention is obtained by coating with polyurethane in solvent phase. The coating may have any one of the characteristic features mentioned below. Firstly, the fabric may be coated on one or both sides, preferably it is coated on one side.

A polyurethane includes a stiff part (isocyanate) and a flexible part (polyol). The person skilled in the art knows how to find the compromise between the isocyanate/polyol ratio and the nature of the components in order to obtain the elastomer of the desired stiffness, characterised by the modulus at 100% elongation. Preferably, the elastomer used in the coating is a single component elastomer, the isocyanate having reacted with the polyol, then with the chain extender or the crosslinking agent, forming an elastomer generally still containing reactive functional groups such as NCO and alcohol. The person skilled in the art may refer to the literature on the production of copolymers or elastomers obtained from isocyanate, polyol, and chain extenders or crosslinking agent, in particular to the Thèse en Matériaux Polymères et Composites [Thesis on Polymer Materials and Composites] by Ségolène Hibon, Institut National de Sciences Appliquées-INSA [National Institute of Applied Sciences) in Lyon, France, 2006.

The coating composition is supplemented by a crosslinking agent, in particular an isocyanate or a melamine, or even a mixture of the two. The term "isocyanate" is understood to refer to both an isocyanate and a polyisocyanate, either alone or as a mixture with one or more other isocyanates and/or polyisocyanates. Unless otherwise indicated, the term "isocyanate" should be understood herein as including the terms "isocyanate" and "polyisocyanate". Polyisocyanates are preferred. As regards the melamine, it may in particular be melamine proper (1,3,5-triazine-2,4,6-triamine) or a compound or a resin containing melamine, for example a melamine-formaldehyde resin.

According to one embodiment, the proportion of dry crosslinking agent relative to the dry elastomer is between approximately 20% and approximately 75% by weight, better still between approximately 30% and approximately 75% by weight, in particular between approximately 40% and approximately 75% by weight, in particular between approximately 50% and approximately 75% by weight.

According to one embodiment, the polyurethane (and the starting elastomer) is polyether-based. In particular, the polyether-based polyurethane is linear or branched and comprises a polyol part of the polyether type and an isocyanate part.

According to one embodiment, the polyurethane (and the starting elastomer) is polyester-based. In particular, the polyester-based polyurethane is linear or branched and comprises a polyol part of the polyester type and an isocyanate part.

According to another embodiment, the polyurethane (and the starting elastomer) is polycarbonate-based. In particular, the polycarbonate-based polyurethane is linear or branched and comprises a polyol part of the polycarbonate type and an isocyanate part. A polycarbonate-based polyurethane is used in the examples and constitutes a particularly suitable embodiment.

As regards the elastomer and the crosslinking agent, the isocyanate part is preferably aliphatic, in fact aromatic isocyanates have the drawback of turning yellow over time, thereby making them less preferred, even though they can be used.

In one embodiment, the lightweight fabric of the present invention is obtained by coating with polyurethane in solvent phase. This fabric production method for producing a coated fabric from the polyester fabric is another object of the invention. The coating may have any one of the characteristic features mentioned below.

The coating step is carried out by the techniques conventionally used in the coating of textiles, such as direct coating. The term "direct coating" is understood to refer to a direct deposition coating process, for example making use of a doctor blade, a cylinder, an air knife, a padder, using the Meyer rod (or Champion process).

Another object of the invention is the use of a PU elastomer or a crosslinked PU coating as defined herein, for the coating of a high tenacity PET fabric as defined herein. This coating is intended in particular to give the fabric the property or properties described herein, in particular an elongation in the bias direction as described herein. The coating also provides a level of porosity appropriate to the use for which the fabric is intended. This use may result in the production method that follows, which is another object of the invention.

The fabric production method for producing the coated fabric includes in particular the following steps:

(a) a polyester fabric according to the invention is provided;

(b) one or both of the two surfaces of this fabric is/are coated making use of a polyurethane in solvent phase according to the invention, preferably from a single-component elastomer dissolved in the solvent and in a mixture with the crosslinking agent, as described herein, with a rate of coating in accordance with the invention;

(c) the fabric is heated until drying and crosslinking of the coating, (d) a coated fabric in accordance with the invention is obtained;

(e) optionally, the fabric is printed, for example by sublimation, on one or both of its two surfaces.

The object of the invention relates in particular to a fabric production method for producing the coated fabric in which:

a fabric is provided, the fabric made of poly(ethylene terephthalate) (PET) having a density of between 20 and 50 threads/cm, preferably between 25 and 50 threads/cm, in terms of warp and weft density;

one or both of the two surfaces of this fabric is/are coated making use of a mixture of: a single-component polyurethane elastomer having a modulus at 100% elongation as described above; a solvent for the elastomer; and a crosslinking agent; based on a proportion of dry crosslinking agent relative to the dry elastomer as described above;

the fabric is heated until drying and crosslinking of the coating;

a coated fabric is obtained;

optionally, the fabric is printed, for example by sublimation, on one or both of its two surfaces.

This method is aimed at producing a fabric as described above and consequently, the characteristic features of the elements that are used in the production of the fabric and its coating are applicable to the method, to the selection of these elements for use thereof in the method, without having to repeat them in the following sections.

In particular, the drying and crosslinking step comprises firstly the drying, for example at a temperature of between approximately 90 and approximately 120° C., thereafter the crosslinking at a temperature of between approximately 140 and approximately 210° C.

In one embodiment, the method includes after the step of drying and crosslinking one or more post-treatment step(s) that confer on the fabric anti-fouling and/or water-repellent properties. The term "anti-fouling" treatment is understood to refer to a treatment making use of anti-static and/or anti-tack products. The term "water-repellent" treatment is understood to refer a treatment making use of fluorinated resins with or without a crosslinking agent for the fluorinated resin, for example an isocyanate. The water-repellent treatment is followed by a drying/crosslinking step. In one embodiment, the post-treatment is applied by any method known to the person skilled in the art and in particular by padding, coating, spraying or plasma treatment. It is also possible to carry out a treatment with silicone in order to ameliorate the slipperiness of the fabric.

According to one embodiment, prior to coating, the fabric is calendered. Calendering crushes the fabric and spreads the yarns as well as the constituent filaments, which contributes to closing the pores of the fabric and reducing the porosity thereof. According to one embodiment, the calendering is carried out between a tool, cylinder or calender roller and a counter plate. The surface of the fabric which has been subjected to the passing of the calendering tool, referred to as the "calendering surface", is smoothed as compared to the other surface.

According to one method, the coating is effected on this calendering surface. The adhesion of the polymer can be enhanced by first applying in advance a primer treatment to this smooth surface. It may be a physical treatment or a chemical treatment known as an adhesion treatment. It is for example a chemical treatment providing functional groups capable of reacting with the groups of the polymer in order to form chemical bonds.

According to another modality, the coating is effected on the other surface, which is not smoothed. It should be understood that the rate of dry coating varies depending on the surface concerned, this rate being higher on the non-smoothed surface, which enables a person skilled in the art to adjust the quantity and the weight of the coating. It is also possible to coat both surfaces.

According to another embodiment, the calendering is carried out between two tools, cylinders or calender rollers. Both surfaces of the fabric are smoothed. One or both of the two surfaces are subsequently coated, with or without an adhesion treatment as described above.

The calendering is preferably carried out at a temperature of between approximately 150 and approximately 250° C., preferably between approximately 180 and approximately 210° C. The calendering is preferably carried out with a pressure ranging from approximately 150 to approximately 250 kg, preferably between approximately 180 and approximately 230 kg. The rotational speed of the calender may be between approximately 1 and approximately 30 m/min, preferably between approximately 10 and approximately 20 m/min.

The fabric of the present invention is obtained by coating with polyurethane dissolved in a solvent. In particular, the coating contains the single-component elastomer (formed in particular from isocyanate, polyol and the chain extender or the crosslinking agent), in solution in the solvent. The film forms naturally during the evaporation of the solvent. The solvent is an organic solvent and may in particular be selected from the group constituted of aromatic solvents, alcohols, ketones, esters, dimethylformamide, and n-methylpyrolidone. In one particular embodiment, the solvent is selected from the group constituted of toluene, xylene, isopropanol, butanol, 1-methoxypropan-2-ol, methyl ethyl ketone, acetone, butanone, ethyl acetate, dimethylformamide, n-methylpyrolidone, and a mixture of at least two of the afore-mentioned. For example, a mixture of toluene and isopropanol.

In one embodiment, the solvent-phase polyurethane may be characterised by its concentration of between 20% and 50% by weight of non-crosslinked PU, in particular a single-component elastomer, relative to the PU and solvent mixture. In one embodiment, this solvent-phase polyurethane, in particular the elastomer in solution in the solvent, may be characterised by a viscosity of less than 100,000 mPa·s at 23° C., preferably between 5,000 and 60,000 mPa·s at 23° C. (according to the standard DIN EN ISO/A3).

Consequently, in one embodiment, the lightweight fabric of the present invention is obtained or can be obtained by coating with polyurethane, preferably a single-component polyurethane elastomer, in solvent phase.

The fabric coating composition of the present invention may in addition include additives. The said additives may be any additive commonly used in fabric coating compositions. They are in particular selected from the group constituted of viscosity modifiers, UV stabilisers, dyes, dispersants, and surfactants. According to one embodiment, the coating comprises an anti-UV agent.

The coated fabrics described herein are found to be capable of being printed by the so-called sublimation printing technique. According to one aspect of the invention, this coated fabric is coloured, printed or decorated by a sublimation technique. This latter may in particular be implemented by printing a pattern on a substrate (transfer substrate) with one or more dyes which can be sublimated at high temperature. The substrate is thereafter applied in contact with the coated fabric, then hot calendered, for example at approximately 200° C. and under pressure. The dyes pass into the gas phase and are transferred into the coating, and/or to the surface and/or to the fibre. The polyester PET remains stable at this temperature.

Spinnakers (standard or asymmetric) and gennakers are inflatable wind sails, which typically include three angular peaks, commonly referred to as head or halyard point, clew point, and tack point. These sails are obtained by assembling fabric widths, in particular several radial widths which open out from each angular vertex, each radial width being obtained beforehand in the form of a planar fabric cutting, cut according to the geometric needs of the width to be obtained.

The object of the invention thus relates to an article such as a headsail for sailboats and other surface vessels, for example a spinnaker, asymmetric spinnaker, and gennaker, which comprises a coated fabric according to the invention or is made from one or more fabric(s) or fabric width(s) coated according to the invention. In particular, the article may comprise multiple fabrics or fabric widths according to the invention, assembled so as to form the article in question. In one embodiment, the nautical sail bears a pattern that is sublimation printed. In particular the nautical sail bears a pattern formed with dye within the PU coating and/or on the surface or within the PET yarns.

The object of the invention thus also relates to the said fabric widths cut from a fabric according to the invention.

The invention will now be described with the aid of examples corresponding to the preferred embodiments, these being provided by way of illustration without however any limitation whatsoever.

EXAMPLE

Example 1

This example compares the impact of a polyurethane coating on conventional polyamide 6.6 fabrics coated with PU (Control) and high tenacity polyethylene terephthalate (PET) fabrics coated on one surface with a PU according to the invention.

PA6.6 is a conventional polyamide fabric in the spinnaker industry, with a PU coating obtained from PU elastomer having a 100% elongation modulus of 32.4 and melamine formaldehyde crosslinking agent. The proportion of dry crosslinking agent relative to the dry elastomer is 104%. The PU is used in a 50/50 mixture of toluene and isopropanol.

The PET has a PU coating obtained from PU elastomer having a 100% elongation modulus of 8, and melamine formaldehyde crosslinker. The proportion of dry crosslinking agent relative to the dry elastomer is 66.9%. The PU is used in a 50/50 mixture of toluene and isopropanol.

The tenacity of PET is 6.8 cN/dtex. The elongation at break is 24.6%.

The coating is effected by using a doctor blade, and is followed by a step of drying at 100° C., and then a step of crosslinking at 170° C. The speed is 27 m/min.

TABLE 1

| | Control | Invention - Example 1 |
|---|---|---|
| Type of yarn | PA6.6 | PET |
| Count (dtex) | 33 | 33 |
| DPF | 3.3 | 2.1 |
| Number of warp yarns × weft yarns | 44 × 45 | 44 × 44.5 |
| PU modulus at 100% elongation (MPa) - standard DIN 53504 | 32.4 | 8 |
| % crosslinking agent (in dry weight) | 104 | 66.9 |
| Weight (g/m$^2$) - ISO2286-2 | 41.2 | 38.4 |
| Bias elongation under 20 Lbs (in 100$^{ths}$ inch) | 10.9 | 20.1 |
| Warp elongation under 20 Lbs (in 100$^{ths}$ inch) | 13.7 | 10.6 |
| Weft elongation under 20 Lbs (in 100$^{ths}$ inch) | 16.8 | 5.7 |
| Breaking strength Warp (daN/5 cm) - NF EN ISO 13934-1 | 42.6 | 38.5 |
| Breaking strength Weft (daN/5 cm) - NF EN ISO 13934-1 | 41.5 | 44.4 |
| Tear resistance Warp (Lbs) - NF EN ISO 13937-2 | 5.7 | 5.3 |
| Tear resistance Weft (Lbs) - NF EN ISO 13937-2 | 4.9 | 5.4 |
| Water absorption - new (%) | 0.3 | 0.02 |
| Water absorption - post aging (%) | 1.1 | 0.1 |

TABLE 2

| | Control | Invention - Example 2 |
|---|---|---|
| Type of yarn | PA6.6 | PET |
| Count (dtex) | 50 | 44 |
| DPF | 3.8 | 3.2 |
| Number of warp yarns × weft yarns | 42 × 42 | 39.3 × 39 |
| PU modulus at 100% elongation (MPa) - standard DIN 53504 | 32.4 | 8 |
| % crosslinking agent (in dry weight) | 104 | 66.9 |
| Weight (g/m$^2$) - ISO2286-2 | 55.0 | 47.0 |
| Bias elongation under 20 Lbs (in 100$^{ths}$ inch) | 9.3 | 16.1 |
| Warp elongation under 20 Lbs (in 100$^{ths}$ inch) | 9.8 | 9.3 |
| Weft elongation under 20 Lbs (in 100$^{ths}$ inch) | 13.3 | 7.9 |
| Breaking strength Warp (daN/5 cm) - NF EN ISO 13934-1 | 63.2 | 50.9 |
| Breaking strength Weft (daN/5 cm) - NF EN ISO 13934-1 | 58.6 | 48.9 |
| Tear resistance Warp (Lbs) - NF EN ISO 13937-2 | 7.4 | 14.1 |
| Tear resistance Weft (Lbs) - NF EN ISO 13937-2 | 5.6 | 12.8 |

Example 2

The fabric of the invention from Example 1 made of 33 dtex yarns is taken and compared with counter-examples 1 and 2, which differ therefrom by combinations of the modulus of the PU and proportion of crosslinking agent which are outside the limits of the invention.

TABLE 3

| | Invention Example 1 | Counter-Example 1 | Counter-Example 2 |
|---|---|---|---|
| Type of yarn | PET | PET | PET |
| Count (dtex) | 33 | 33 | 33 |
| DPF | 2.1 | 2.1 | 2.1 |
| Number of warp yarns × weft yarns | 44 × 44.5 | 44 × 44.5 | 44 × 44.5 |

TABLE 3-continued

| | Invention Example 1 | Counter-Example 1 | Counter-Example 2 |
|---|---|---|---|
| PU modulus at 100% elongation (MPa) - standard DIN 53504 | 8 | 2 | 8 |
| % crosslinking agent (in dry weight) | 66.9 | 15.4 | 16.5 |
| Weight (g/m$^2$) - ISO2286-2 | 38.4 | 38.6 | 38.5 |
| Bias elongation under 20 Lbs (in 100$^{ths}$ inch) | 20.1 | 53.8 | 47.4 |
| Warp elongation under 20 Lbs (in 100$^{ths}$ inch) | 10.6 | 8.8 | 10.4 |
| Weft elongation under 20 Lbs (in 100$^{ths}$ inch) | 5.7 | 6.6 | 6.3 |
| Breaking strength Warp (daN/5 cm) - NF EN ISO 13934-1 | 38.5 | 39.4 | 39.7 |
| Breaking strength Weft (daN/5 cm) - NF EN ISO 13934-1 | 44.4 | 40.4 | 43.3 |
| Tear resistance Warp (Lbs) - NF EN ISO 13937-2 | 5.3 | 9.7 | 7.5 |
| Tear resistance Weft (Lbs) - NF EN ISO 13937-2 | 5.4 | 9.5 | 8.0 |
| Water absorption - new (%) | 0.02 | 0.4 | 0.1 |
| Water absorption - post aging (%) | 0.1 | 0.9 | 0.2 |

Methods and Measurements Used in the Application (Characteristic Features of the Invention and Examples):

NF EN ISO 2062—Determination of the breaking strength and elongation at break of individual yarns making use of a constant rate of elongation test apparatus, using Method A of the standard.

Breaking force (unit centiNewton—cN): maximum force developed to break the sample during a tensile test leading to breakage Elongation at break (%): increase in the length of the sample measured at breaking of the latter Tenacity (cN/tex): quotient of the breaking force expressed in cN by the linear density of the yarn expressed in dtex (1 tex=1 g per 1000 m of yarn length).

The test makes it possible to measure the force and the elongation at break of the sample, characteristic variables of the yarn.

The yarn is placed between two fixing clamps, spaced apart by 500 mm. The apparatus (Dynamometer) then moves the clamps away from each other at a constant displacement speed of 500 mm/min and measures the applied force continuously. The force required to break the yarn is measured as well as the increase in length of the yarn upon breaking.

The mean breaking strength and mean elongation at break are the two data items characterised by this test. The tenacity is calculated based on dividing the breaking force by the linear density.

The modulus at 100% elongation of the single-component polyurethane elastomer is measured according to the standard DIN 53504. The modulus is defined in 3.4 of the standard "Spannungswerte". The measurement is carried out on test specimens that are dumbbell-shaped (Schulterstab) of type S2, however with a bar length $l_S$ of 55 mm and a thickness of 200 μm. The equipment used is a dynamometer. The dumbbell specimen is placed in the fixing clamps, spaced apart by a length $L_0$ with the minimum possible pre-tension. The clamps are then moved away from each other at a constant speed of 400 mm/min and the dynamometer measures the force applied as a function of the elongation. The modulus or stress at 100% elongation in MPa is the force ratio measured at 100% elongation on the initial section of the specimen. This is described in paragraph 9.4 Spannungswerte of the standard DIN 53504.

The elongations of the fabric are measured according to the standard NF EN ISO 13934-1, as described in the general description. The lesser elongation in the direction of the warp and weft yarns due to the polyester nature is compensated by a greater elongation in the bias (measured herein in the warp direction). This elongation in the bias effectively serves to compensate for the excessive rigidity of the PET and enables avoiding the risks of breaking and bursting under high stresses. The mechanical performance results are equivalent or indeed even superior, this consequently leads to a polyester fabric that is suitable for use in spinnaker production.

The absorption of water by the coated fabric of Example 1 was measured according to the standard Tappi 441 om-90. One measurement was performed on the new coated fabric, with another performed post aging. The measurement is expressed in percentage. The equipment consists of a square rubber substrate and a metal ring clad at its base with a rubber gasket. The sample is placed on the square substrate and the metal ring is placed on the sample. A clamping device is used to make the system watertight. A certain quantity of water (100 ml) is placed in the ring, in contact with the sample for a determined time (1 minute). When the time has elapsed, the water is removed from the cylindrical ring, the water residue remaining on the surface of the sample is removed by using a cylinder as described in the standard, via a to-and-fro movement of this cylinder over the sample placed between two blotters, without applying pressure. The percentage of water absorbed is determined by calculating the difference in weight before and after the contact with water.

For the aging, the fabric is placed for 4 hours in a 'Cocotte Minute' pressure cooker with salted water (30 g/l) at operating temperature and pressure. Subsequently 1 hour of treatment is applied by floating the fabric in open air and at high speed, the fabric being fixed to a mill-type assembly (4 blade assembly, the fabric being fixed to the end of one of the blades).

It is thus demonstrated that the fabric according to the invention undergoes practically no unfavourable evolution in terms of its water absorption after aging. This level of resistance to water uptake is another surprising positive result.

The invention claimed is:

1. A fabric for lightweight nautical sails for sailboats and other surface vessels, the fabric comprising two surfaces, is formed of continuous polyester warp and weft yarns and is coated on one or both of its two surfaces with a crosslinked polymer, wherein:

the polyester is poly(ethylene terephthalate) (PET);

the PET has a tenacity greater than or equal to 6 cN/dtex-;

the fabric has a density of between 20 and 50 threads/cm, in terms of warp and weft density;

the polymer is a crosslinked polyurethane (PU) that is polyether-, polyester-, or polycarbonate based; and the PU is derived from the crosslinking (1) of a single-component polyurethane elastomer having a modulus at 100% elongation of between 6 and 15 MPa, according to the standard DIN 53504, used in implementation in solvent phase; (2) by a crosslinking agent, based on a proportion of dry crosslinking agent relative to the dry elastomer of between 40% and 75% by weight; and the coated fabric has an elongation in the bias direction under 20 lbs of between 10 and 30 hundredths of an inch, measured on test specimens measuring 76 2 mm in width and 300 mm in length and according to the standard NF EN ISO 13934-1.

2. The fabric according to claim 1, wherein said single-component polyurethane elastomer has a modulus at 100% elongation comprised between 6 and 10 Mpa, according to the standard DIN 53504.

3. The fabric according to claim 1, wherein said single-component polyurethane elastomer has a modulus at 100% elongation comprised between 6 and 9.5 MPa, according to the standard DIN 53504.

4. The fabric according to claim 1, wherein the proportion of dry crosslinking agent relative to the dry elastomer is between 50% and 75% by weight.

5. The fabric according to claim 1, wherein the PET has a tenacity of between 6 and 7 cN/dtex.

6. The fabric according to claim 1, wherein said fabric has a density of between 25 and 50 threads/cm, in terms of warp and weft density.

7. The fabric according to claim 1, wherein the coated fabric has an elongation in the bias direction under 20 lbs, comprised between 14 and 25 hundredths of an inch, measured on test specimens measuring 76.2 mm in width and 300 mm in length and according to the standard NF EN ISO 13934-1.

8. The fabric according to claim 1, wherein the fabric comprises warp yarns and weft yarns which have a count of between 11 and 235 dtex, with a DPF (decitex per filament) of between 1 and 4.

9. The fabric according to claim 1, wherein the fabric comprises warp yarns and weft yarns which have a count of between 22 and 110 dtex, with a DPF (decitex per filament) of between 1 and 4.

10. The fabric according to claim 1, wherein the fabric comprises warp yarns and weft yarns which have a count of between 22 and 78 dtex, with a DPF (decitex per filament) of between 1 and 4.

11. The fabric according to claim 8, wherein the fabric comprises warp yarns and weft yarns have a DPF (decitex per filament) of between 1.3 and 3.5.

12. The fabric according to claim 1, wherein the PET has an elongation at break greater than or equal to 20%, according to the standard DIN EN ISO 2062.

13. The fabric according to claim 1, wherein the PET has an elongation at break between 20 and 30%, according to the standard DIN EN ISO 2062.

14. The fabric according to claim 1, wherein the rate of dry coating of crosslinked PU relative to the fabric is greater than 5% by weight.

15. The fabric according to claim 1, wherein the rate of dry coating of crosslinked PU relative to the fabric is between 5% and 30% by weight.

16. The fabric according to claim 1, wherein the rate of dry coating of crosslinked PU relative to the fabric is between 10% and 30% by weight.

17. The fabric according to claim 1, wherein the rate of dry coating of crosslinked PU relative to the fabric is between 15% and 25% by weight.

18. The fabric according to claim 1, wherein the weight of the coated fabric is between 25 and 130 $g/m^2$.

19. The fabric according to claim 1, wherein the cross-linking agent of the elastomer is selected from the group consisting of an isocyanate, a polyisocyanate, melamine, a compound comprising melamine, and a mixture of isocyanate and melamine.

20. The fabric according to claim 19, wherein said isocyanate and said polyisocyanate, is aliphatic.

21. A lightweight nautical sail which comprises at least one fabric according to claim 1.

22. The lightweight nautical sail according to claim 1, which sail is selected from the group consisting of a spinnaker, an asymmetric spinnaker, and a gennaker.

23. The lightweight nautical sail according to claim 21, wherein said sail bears a pattern that is sublimation printed.

24. A fabric production method for producing a coated fabric according to claim 1, comprising:

a fabric is provided, which is made of poly (ethylene terephthalate) (PET) having a density of between 20 and 50 threads/cm, in terms of warp and weft density; and the PET has a tenacity greater than or equal to 6 cN/dtex;

said fabric has two surfaces, one or both of these two surfaces is/are coated making use of a mixture of: a single-component polyurethane elastomer having a modulus at 100% elongation comprised between 6 and 15 MPa, according to the standard DIN 53504; a solvent for the elastomer; and a crosslinking agent; based on a proportion of dry crosslinking agent relative to the dry elastomer of between 20% and 75% by weight,;

the fabric is heated until drying and crosslinking of the coating;

a coated fabric is obtained;

optionally, the fabric is printed by sublimation, on one or both of its two surfaces.

* * * * *